United States Patent [19]

Sukenobu

[11] Patent Number: 4,607,493

[45] Date of Patent: Aug. 26, 1986

[54] CRYOSORPTION PUMP

[75] Inventor: Satoru Sukenobu, Tokyo, Japan

[73] Assignee: Kabushiki Kaisha Toshiba, Kawasaki, Japan

[21] Appl. No.: 650,860

[22] Filed: Sep. 17, 1984

[30] Foreign Application Priority Data

Sep. 20, 1983 [JP] Japan ..... 58-172182

[51] Int. Cl.[4] ..... B01D 8/00

[52] U.S. Cl. ..... 62/55.5; 55/269; 62/3; 62/100; 62/268; 417/901

[58] Field of Search ..... 62/100, 268, 55.5, 3; 55/269; 417/901

[56] References Cited

U.S. PATENT DOCUMENTS

| | | | |
|---|---|---|---|
| 3,066,849 | 12/1962 | Beams | 62/55.5 |
| 3,175,373 | 3/1965 | Holkeboer et al. | 62/55.5 |
| 3,236,442 | 2/1966 | Davis et al. | 62/55.5 |
| 3,296,773 | 1/1967 | Hemstreet | 55/27 |
| 3,338,063 | 8/1967 | Hogan et al. | 62/55.5 |
| 4,207,746 | 7/1980 | McFarlin | 62/55.5 |

OTHER PUBLICATIONS

"Performance of BNL-TSTA Compound Cryopump".

*Primary Examiner*—Ronald C. Capossela

*Attorney, Agent, or Firm*—Schwartz, Jeffery, Schwaab, Mack, Blumenthal & Evans

[57] ABSTRACT

A cryosorption pump for high vacuum condition to be evacuated generally comprises a cryopumping container connected to a chamber to be evacuated, and cryosorption and cryocondensation members located in the container. The cryocondensation member surrounds the cryosorption member on which an adsorbent is applied to adsorb gases which are not beforehand condensed on the cryocondensation member. A coil means or magnet means for generating a magnetic field is also disposed in the container so as to generate a magnetic field around the cryosorption member to prevent from the impingement of energetic electrons or $\beta$-rays emitted from a material condensed on the cryocondensation member against the cryosorption member.

6 Claims, 7 Drawing Figures

CRYOSORPTION PUMP

BACKGROUND OF THE INVENTION

This invention relates to a cryosorption pump having an improved construction for obtaining a high vacuum condition in a pumping system.

A usual cryosorption pump is provided with a pumping chamber to be evacuated to obtain a high vacuum condition and with a cryosorption member having an extremely low temperature surface, i.e. cryosurface, disposed at substantially the central portion of the pumping chamber so as to be cooled to a temperature of about 4.2 K. (absolute temperature) by means of liquid helium. However, helium is not condensed and evacuated on the cryosurface at the temperature of about 4.2 K. for the reason that helium has a high equilibrium vapour pressure. In order to evacuate the helium, the cryosurface of the cryosorption member is coated with an adsorbent such as active carbon and molecular sieves, or a condensed gas layer composed of a gas such as Ar or $CO_2$ gas.

In the cryosorption pump of the type described above, a further cryocondensation member (or members) on which no adsorbent is applied is (or are) arranged so as to surround the cryosorption member on which the adsorbent is applied. The former mentioned cryocondensation member (or members) serves (or serve) to preliminarily condense gases other than helium which are condensed at a temperature of about 4.2 K. thereby to reduce an excessive gas load on the cryosurface of the later mentioned cryosorption member on which the adsorbent is applied.

For example, in a nuclear fusion system in which the use of the cryosorption pump will be required, a large amount of gases such as deuterium, tritium and helium are to be evacuated. When the conventional cryosorption pump is used for the nuclear fusion system, deuterium and tritium gases will be condensed on the cryosurface on which no adsorbent is applied, whereas helium will be adsorbed on the cryosurface on which the adsorbent is applied. However, as is known, for example, tritium emits $\beta$-rays (a kind of energetic electron) each having maximum energy of 18.6 KeV and average energy of 5.96 KeV when the tritium decays with a half life of 12.3 years. Since the $\beta$-rays are emitted from the tritium once condensed on the cryosurface substantially directly into the atmosphere in a case where no magnetic field is generated therein, some of $\beta$-rays impinge on the cryosurface on which the adsorbent is applied. The helium gas adsorbed on the adsorbent is usually very weakly adsorbed, so that a large amount of the helium is desorbed by the impact of the $\beta$-rays, which is generally called "electron impact desorption". This phenomenon adversely results in the lowering of the effective pumping speed of the helium on the cryosurface. This is not advantageous for the cryopumping operation.

Moreover, in a cryopumping chamber of a nuclear fusion system, secondary electrons are emitted by the impact of the $\beta$-rays or fast particles such as neutrons against the wall surface of the chamber and electrons are also generated therein by the Compton effect. These electrons then impinge on the cryosurface on which the helium is adsorbed, thus separating the helium. This is a significant problem for the cryopumping system.

SUMMARY OF THE INVENTION

An object of this invention is to obviate problems in a cryosorption pump of the prior type and provide an improved cryosorption pump capable of preventing electrons or $\beta$-rays from the impingement on a cryosurface on which helium gas is adsorbed for example in a nuclear fusion system thereby to increase the effective pumping speed for helium gas.

According to this invention there is provided a cryosorption pump for obtaining a high vacuum condition comprising a container defining therein a space connected to an opening of a chamber to be evacuated, a cryosorption panel which is located in the container and on which an adsorbent is applied, a plurality of cryocondensation chevron baffles arranged on both sides of the cryosorption panel so as to exhibit the longitudinal side surfaces thereof to the opening of the chamber, a magnetic field generating member arranged to generate a magnetic field around the cryosorption panel, a unit for supplying cooling medium to the cryosorption panel and chevron baffles, and an exhaust pipe for exhausting gases in the container outwardly.

According to this invention, a coil means or magnet means is located in a cryopumping container for generating a magnetic field around the cryosorption panel, so that electron such as $\beta$-rays emitted from a tritium, for example, are subjected to cyclotron gyration under the effect of the magnetic field thereby to prevent electron impact against the cryosorption panel on which helium is adsorbed, thus increasing the exhausting speed thereof as well as lowering the gas condensing or pumping performance and reducing the degradation of an adsorbent applied on the cryosorption panel.

DESCRIPTION OF THE PREFERRED EMBODIMENTS

Figure 1A:
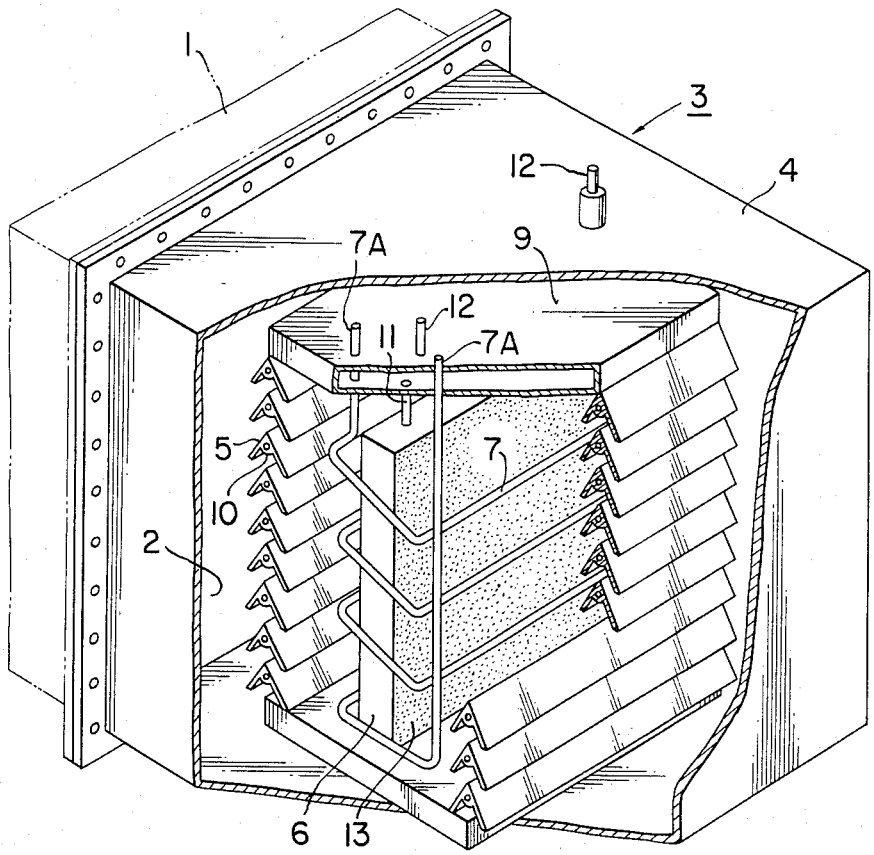
FIG. 1A shows a perspective view of a cryosorption pump, partially broken away, according to this invention.
Figure 1B:
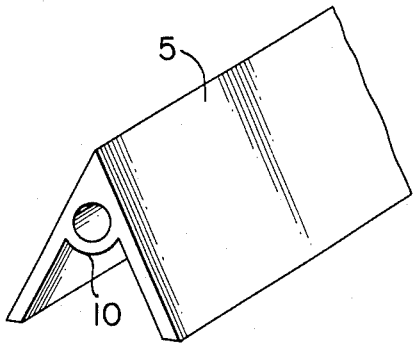
FIG. 1B shows a perspective view of a part of a cryocondensation chevron baffle disposed in the cryosorption pump shown in FIG. 1B.
Figure 2:
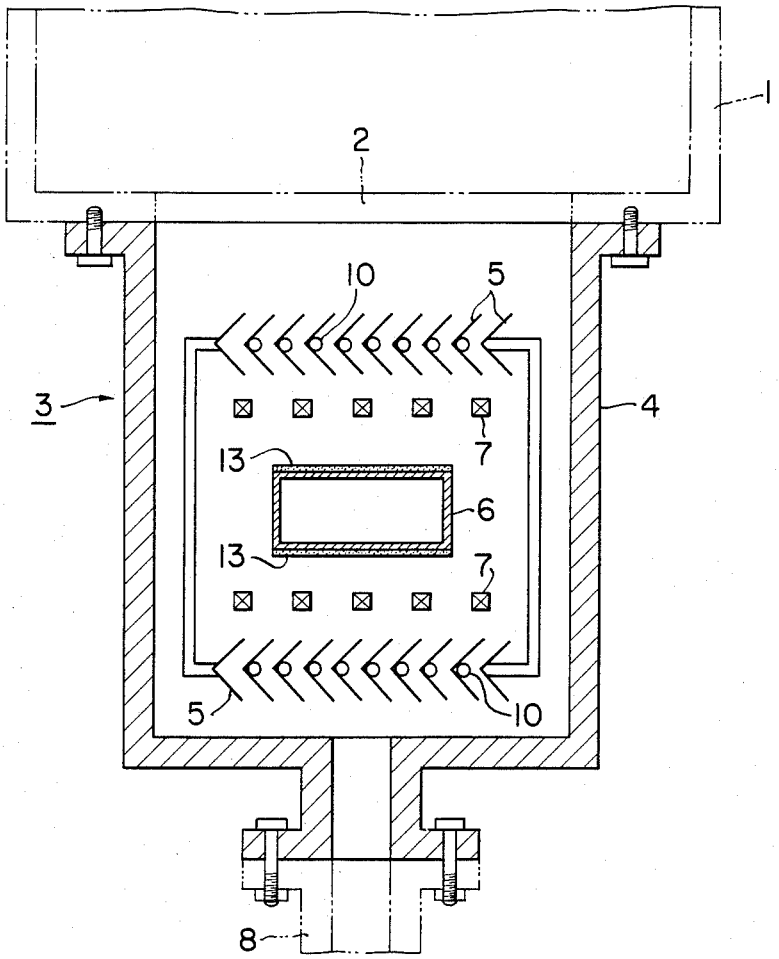
FIG. 2 shows a schematic sectional view of a cryosorption pump of the type shown in FIG. 1A.

FIG. 1A shows a perspective view of a cryosorption pump 3 connected to a chamber 1 to be subjected to evacuating operation through an opening 2 formed on one side wall of the chamber 1. The cryosorption pump 3 generally comprises a container 4 made of a non-magnetic material such as stainless steel air-tightly coupled to the wall of the chamber 1 provided with the opening 2, a plurality of cryosorption chevron baffles 5 parallelly disposed in the container for condensing and evacuating at a temperature of about 4.2 K., a hollow cryosorption panel 6 also disposed in the container 4 for evacuating noncondensable gases which pass by the cryocondensation chevron baffles 5 at a temperature of about 4.2 K., and coil means 7 arranged to surround the cryosorption panel 6 for generating magnetic field. The cryocondensation chevron baffles 5 are arranged in parallel on both sides of the cryosorption panel 6 so as to exhibit their longitudinal side surfaces to the opening of the chamber 1 as shown in FIG. 1. An exhaust pipe 8 is connected to one wall of the container 4 as shown in FIG. 2. An adsorbent 13 such as an active carbon is applied on the outer surface of the cryosorption panel 6. A reservoir 9 is disposed in the container 4 for storing liquid helium which circulates through pipes 10 attached to the cryocondensation chevron baffles 5 to cool the same and is also supplied inside a hollow portion of the cryosorption panel 6 through a pipe 11 to cool the same. The supply of the liquid helium from the outside of the container 4 into the reservoir 9 or the take-out of the liquid helium therefrom is performed through pipes 12. The pipes 10 may be preferably arranged at the inner top portions of the cryocondensation chevron baffles 5 as shown in FIG. 1B. The leading ends 7A of the coil means 7 project outwardly of the container 4.

FIG. 2 is a schematic vertical sectional view of the cryosorption pump 3 shown in FIG. 1 for facilitating the understanding of the arrangement of the constructional elements described before, but is not necessarily identical with shown in FIG. 1 with respect to the arrangement positional relationship. The supply pipes 11 and 12 and the leading ends 7A of the coil means 7 have been omitted from FIG. 2 for the sake of clarity.

The cryosorption pump 3 shown in FIGS. 1 and 2 operates as follows. The chamber 1 is beforehand evacuated so as to obtain a soft vacuum condition therein. The liquid helium is then circulated from the reservoir 9 through the pipes 10 to cool the cryocondensation chevron baffles 5. The coil means 7 is energized to generate the magnetic field near the cryosorption panel 6 and the liquid helium is then introduced into the hollow portion of the cryosorption panel 6 through the pipe 11 to cool the same.

When a cryosorption pump of the type described above is used, for example, for a vacuum system of a nuclear fusion system in which D-T (deuterium-tritium) reaction is carried out, the deuterium or tritium which is a fuel of a nuclear fusion reaction is condensed on the surfaces of the cryocondensation chevron baffles 5. The helium gas as an ash produced by the nuclear fusion reaction is not condensed on the cryosorption chevron baffles 5 at a temperature of about 4.2 K. and is then adsorbed by the adsorbent 13 applied on the crysorption panel 6. The tritium decays and emits $\beta$-rays each having the maximum energy of 18.6 KeV and average energy of 5.69 KeV. When the $\beta$-rays are emitted towards the cryosorption panel 6, the helium once adsorbed thereon is desorbed by the so-called electron impact desorption, which results in the degradation of performance of the cryosorption pump 3. In case the adsorbent on the cryosorption panel 6 is composed of condensed gas layers such as Ar, Xe and $CO_2$, these gases are also desorbed by the electron impact, which also results in the degradation of the adsorbent itself.

Figure 3:
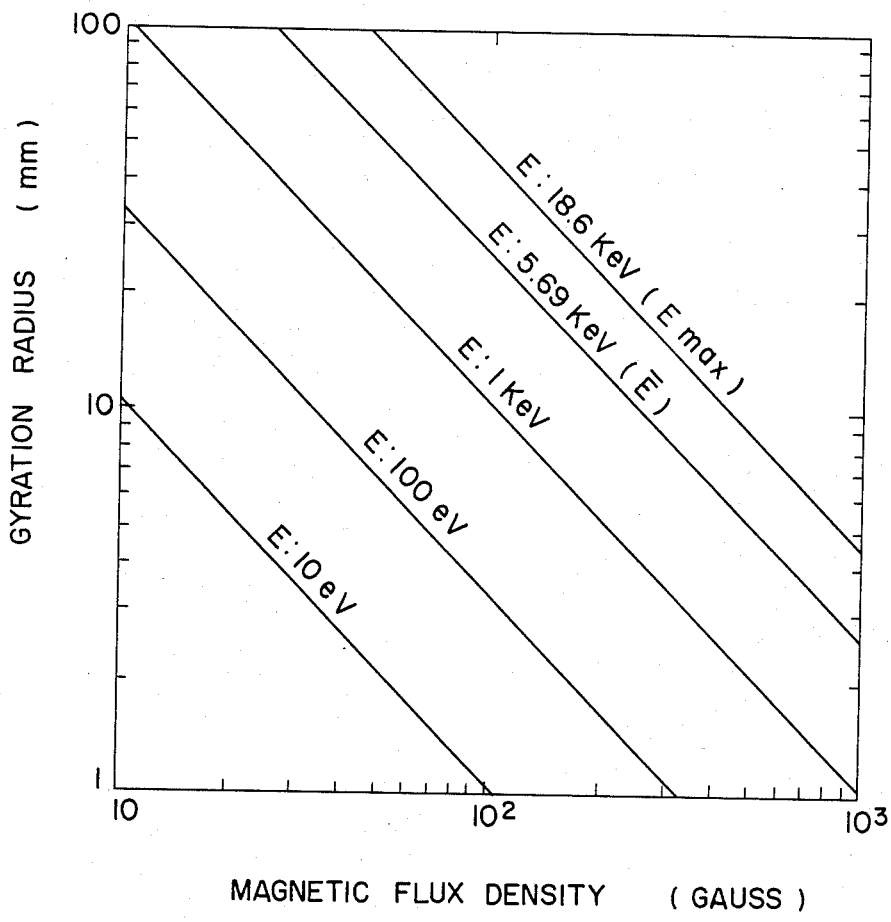
FIG. 3 is a graph showing cyclotron gyration radius of a $\beta$-ray for supporting the disclosure of this invention.

In order to prevent the electron impact of the $\beta$-rays, according to this invention, the coil means 7 is energized to generate the magnetic field around the cryosorption panel 6. When the $\beta$-rays traverse the magnetic field, cyclotron gyration is caused by the magnetic field so that the $\beta$-rays will not impact against the adsorbent 13 on the cyrosorption panel 6. FIG. 3 shows a graph representing the relationship between the cyclotron gyration radius of the $\beta$-ray and the magnetic flux density. As can be understood from FIG. 3, the $\beta$-ray carries out cyclotron gyration with a radius of less than several mm in a magnetic field having an intensity of from several hundred gauss to several thousand gauss. In view of these facts, with the cryosorption pump 3 provided with the coil means 7 arranged as shown in FIG. 1 or 2, the electrons making up the $\beta$-rays emitted from the tritium condensed on the cryocondensation chevron baffles 5 are gyrated by the magnetic field generated by the coil means 7, and thus, the $\beta$-rays do not reach the cryosorption panel 6 and the helium adsorbed on the adsorbent 13 thereon is not adversely desorbed.

Figure 4A:
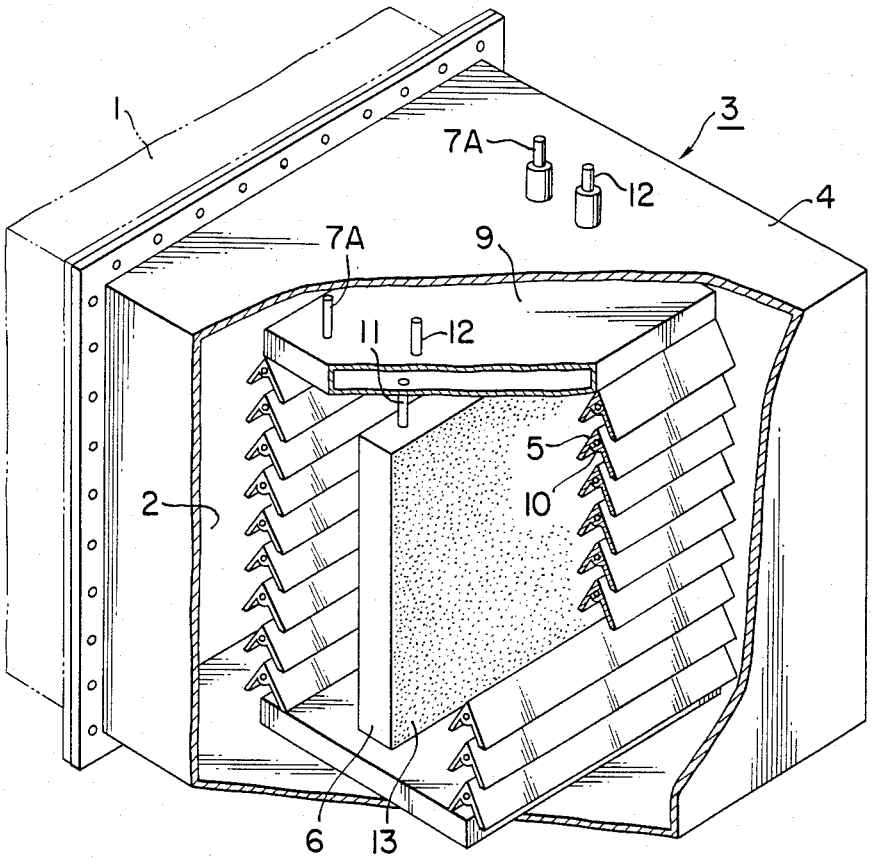
FIG. 4A shows a perspective view of another embodiment of a cryosorption pump, partially broken away, according to this invention.
Figure 4B:
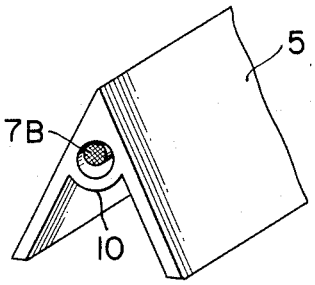
FIG. 4B shows a perspective view of a part of a cryocondensation chevron baffle of the cryosorption pump shown in FIG. 4A.

FIG. 4A shows another embodiment of the cryosorption pump according to this invention. In this embodiment, coil means 7B is disposed in contact with the respective cryocondensation chevron baffles 5 preferably at and along inner top portions thereof as shown in FIG. 4B instead of the separate coil arrangement shown in FIG. 1. Moreover, in this coil arrangement, it is desirable to use superconducting coil means 7B to disperse thermal energy of the coil means 7B and to reduce thermal load to the cryosorption chevron baffles 5 as well as the cryosorption panel 6.

Figure 5:
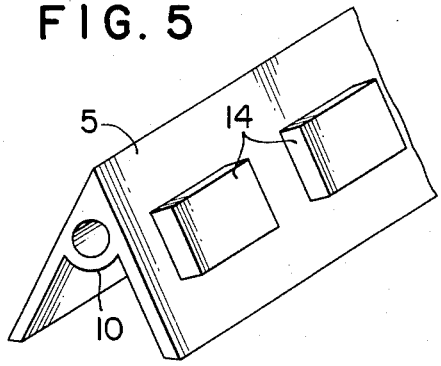
FIG. 5 shows a perspective view of a part of another cryocondensation chevron baffle on which magnets are attached.

In the embodiments described hereinbefore, although the coil means 7 or 7B is used to generate the magnetic field to prevent electron ($\beta$-ray) impingement on the cryosorption panel 6, a magnetic material can be used in place for the coil means. FIG. 5 shows one example of an arrangement of the magnets 14 on the surface of the cryocondensation chevron baffle 5 at equally spaced intervals for generating a cusp field. The magnets are of course disposed at positions apart from the cryocondensation chevron baffles 5 in the container 4 by using some supporting members.

It is to be understood that this invention is not limited to the embodiments illustrated in the accompanying drawings, and changes and variations may be made without departing from the spirit and scope as defined in the appended claims.

What is claimed is:

1. A cryosorption pump for high vacuum condition to be evacuated comprising:

a container defining therein a cryopumping space connected to an opening of a chamber to be evacuated;

a cryosorption member which is located in said container and on which an adsorbent is applied;

a cryocondensation member located in said container so as to surround said cryosorption member;

means for creating a magnetic field outside of said cryosorption member;

means for supplying cooling medium to said cryosorption and cryocondensation members; and means connected to said container for exhausting outwardly gases in said container.

2. The cryosorption pump according to claim 1 wherein said cryosorption member comprises a hollow cryosorption panel and said cryocondensation member comprises a plurality of cryosorption chevron baffles arranged in parallel on both sides of said cryosorption panel so as to exhibit longitudinal side surfaces of said cryocondensation chevron baffles to the opening of said chamber to be evacuated.

3. The cryosorption pump according to claim 1 wherein said magnetic field generating means comprises a coil arranged so as to surround said cryosorption member.

4. The cryosorption pump according to claim 1 wherein said magnetic field generating means comprises a superconducting coil attached to and along the cryocondensation member so as to generate a magnetic field around said cryosorption member.

5. The cryosorption pump according to claim 1 wherein said magnetic field generating means comprises a plurality of magnets located on an outer surface of said cryocondensation member at equally spaced intervals to generate a cusp field.

6. A cryosorption pump for use in an environment such as in a nuclear fusion system in which radiation composed of charged particles is generated for attaining high vacuum condition comprising:

a container defining therein a cryopumping space connected to an opening of a chamber to be evacuated;

a cryosorption member which is located in said container and on which an adsorbent is applied;

a cryocondensation member located in said container so as to surround said cryosorption member, on said cryocondensation member being condensed a substance which emits said charged particles;

means for generating a magnetic field outside of said cryosorption member for preventing said charged particles from reaching said cryosorption member;

means for supplying cooling medium to said cryosorption member and said cryocondensation member; and means connected to said container for exhausting gases outwardly in said container.

* * * * *